United States Patent [19]

Bockwinkel et al.

[11] 4,345,630

[45] Aug. 24, 1982

[54] METHOD OF MAKING RABBETED SHINGLE BUTT JOINT SIDEWALL PANEL

[75] Inventors: Joe L. Bockwinkel, Winlock; Willis G. Pehl, Chehalis, both of Wash.

[73] Assignee: Shakertown Corporation, Winlock, Wash.

[21] Appl. No.: 143,301

[22] Filed: Apr. 24, 1980

[51] Int. Cl.[3] ..... E04C 2/10; E04C 2/40

[52] U.S. Cl. ..... 144/346; 52/558; 52/555; 428/50; 156/258

[58] Field of Search ..... 156/257, 268, 60, 258, 156/265, 562; 52/560, 555, 557, 558, 559, 541, 540, 518, 539; 144/314 R, 316 R, 315, 309 Q; 428/50

[56] References Cited

U.S. PATENT DOCUMENTS

| | | | |
|---|---|---|---|
| 309,071 | 12/1884 | Mankey | 52/313 |
| 322,917 | 7/1885 | Donaldson | 52/541 |
| 380,203 | 3/1888 | Henderson | 52/518 |
| 512,986 | 1/1894 | Montross | 52/541 |
| 1,534,165 | 4/1925 | Cumfer | 52/558 |
| 2,091,476 | 8/1937 | Elmendorf | 52/313 |
| 2,532,017 | 11/1950 | Elmendorf | 52/518 |
| 2,680,267 | 6/1954 | Remstein | 52/541 |
| 2,935,768 | 5/1960 | Roupe | 52/560 |
| 2,965,531 | 12/1960 | Barker | 156/257 |
| 3,262,239 | 7/1966 | Mills | 52/541 |
| 3,345,244 | 10/1967 | Stolesen | 156/268 |
| 3,546,843 | 12/1970 | Luebs | 52/560 |

FOREIGN PATENT DOCUMENTS

| | | | |
|---|---|---|---|
| 620868 | 5/1961 | Canada | 52/541 |
| 1058375 | 7/1979 | Canada | 52/313 |

*Primary Examiner*—Price C. Faw, Jr.
*Assistant Examiner*—H. E. Raduazo
*Attorney, Agent, or Firm*—Robert W. Beach; Douglas E. Winters; Ward Brown

[57] ABSTRACT

A method of making wood shingle sidewall panels by assembling a layup including a face layer of high-grade tapered wood shingles with their longitudinal edges in abutment, each such shingle having a rabbeted longitudinal edge, an intermediate layer of veneer and a backing layer of wood shingles tapered opposite to the taper of the face wood shingles, and bonding the shingle layers to the opposite sides of the veneer, respectively. The face layer of sidewall panel shingles having rabbeted edges simulates the appearance of shingles individually applied to a wall.

4 Claims, 10 Drawing Figures

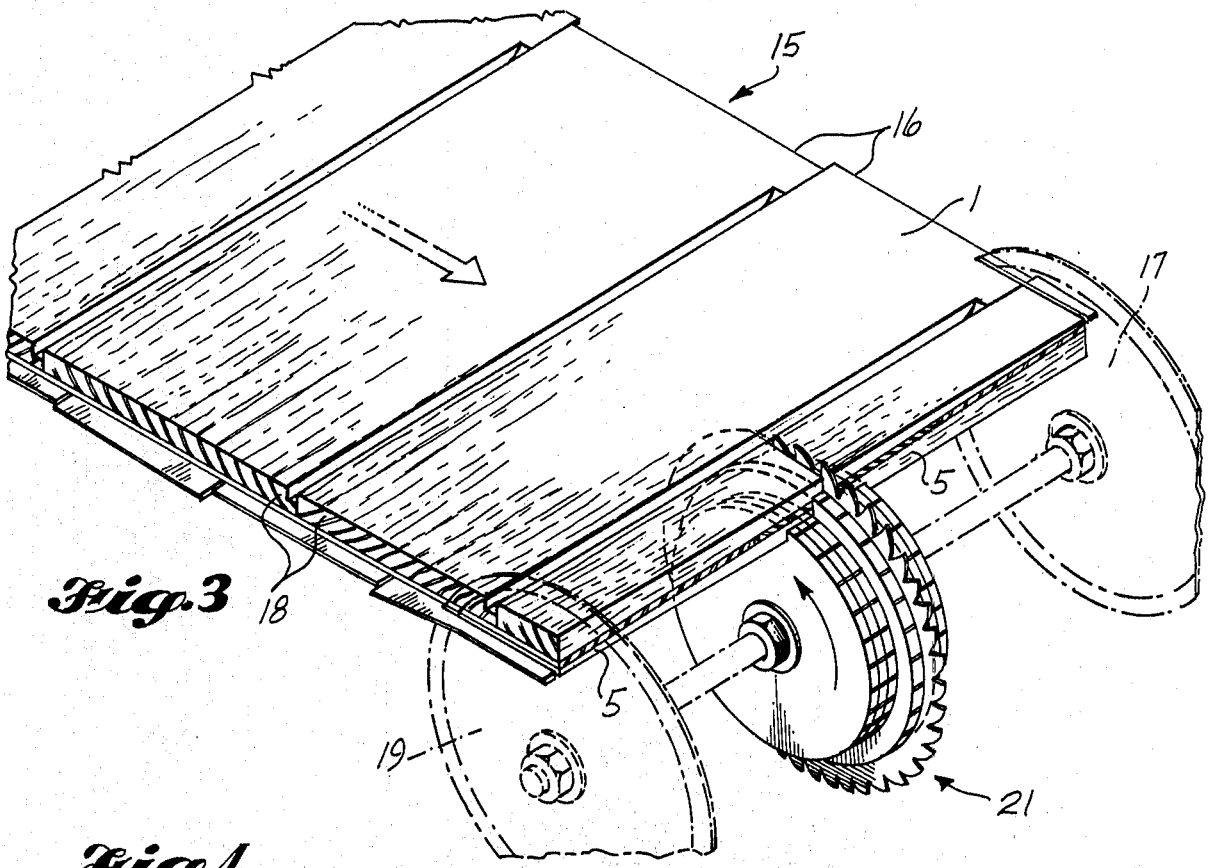
Fig. 3
Fig. 4
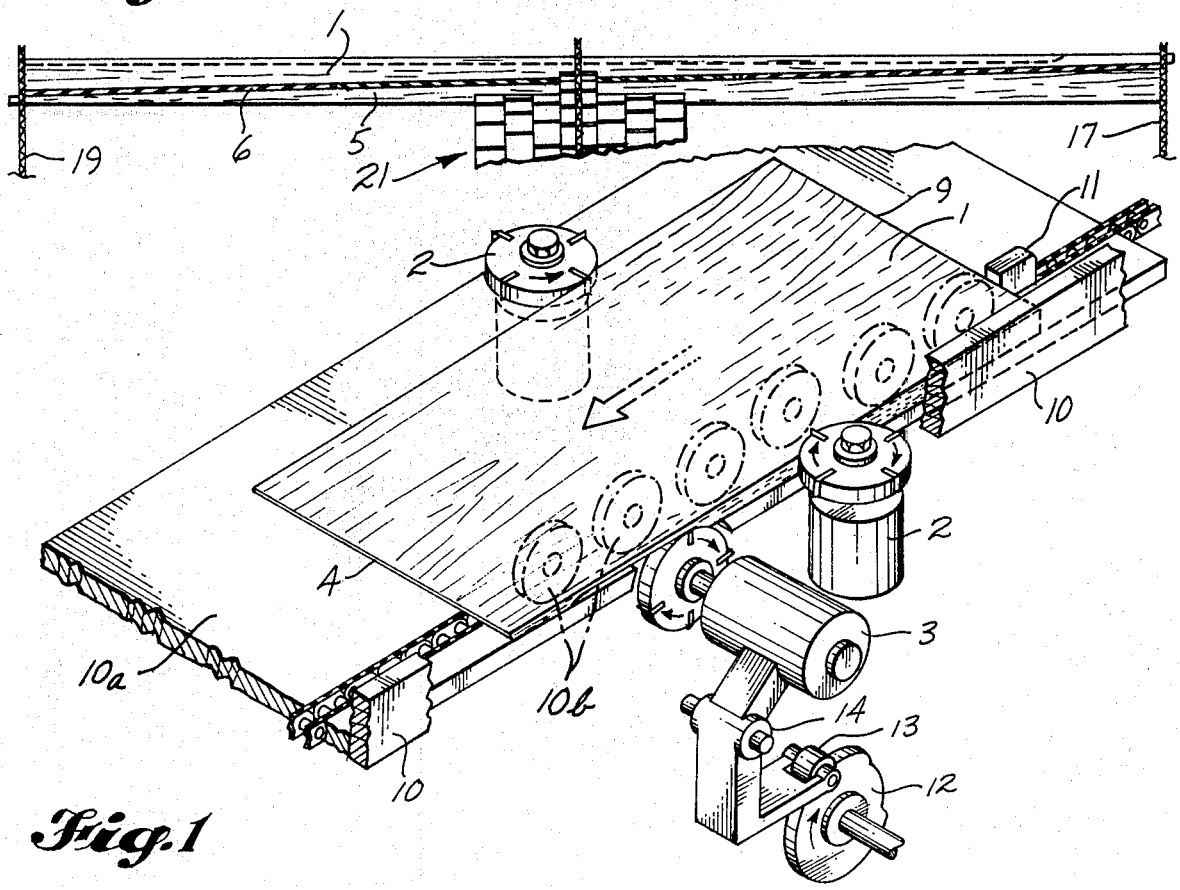
Fig. 1

Fig. 5A
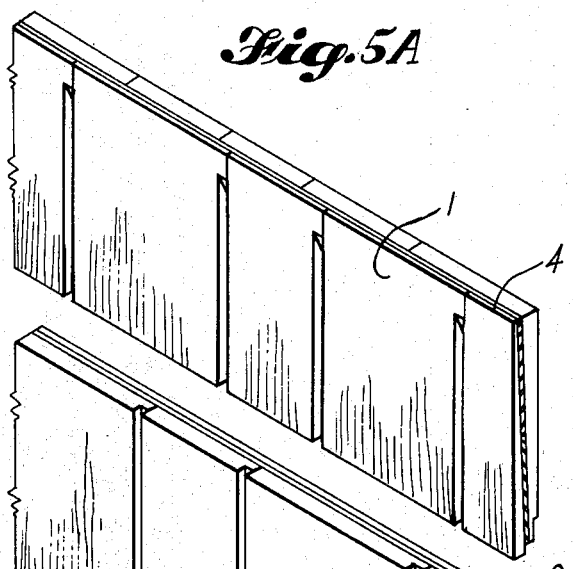
Fig. 6A
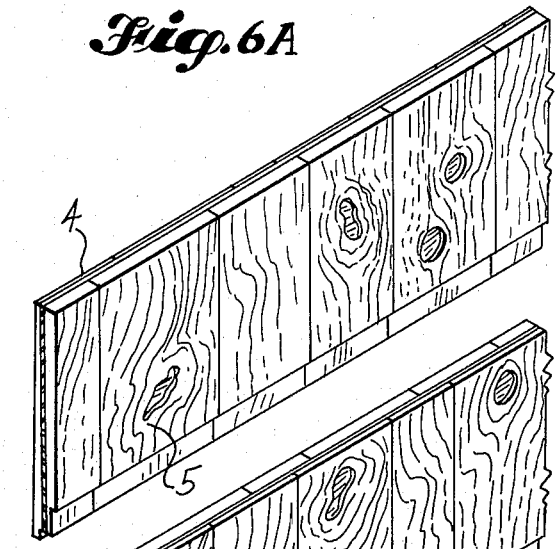
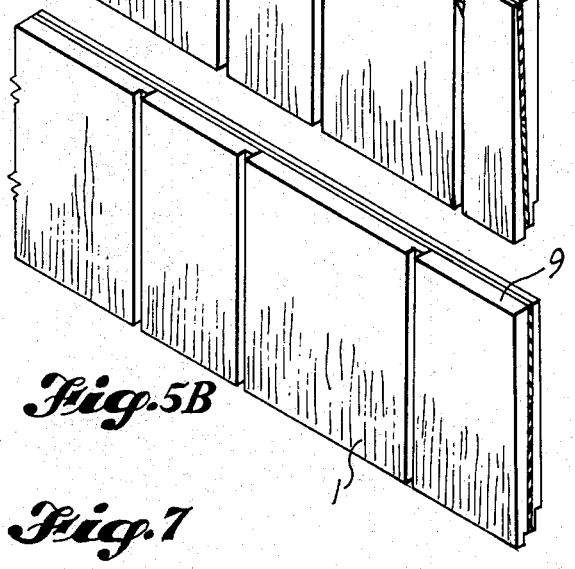
Fig. 5B
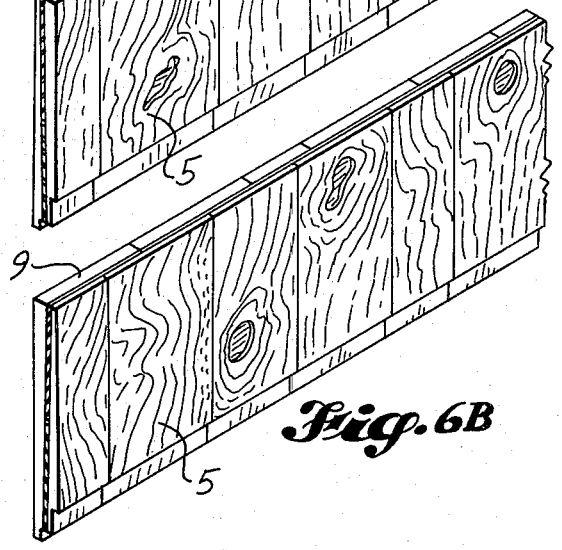
Fig. 6B
Fig. 7
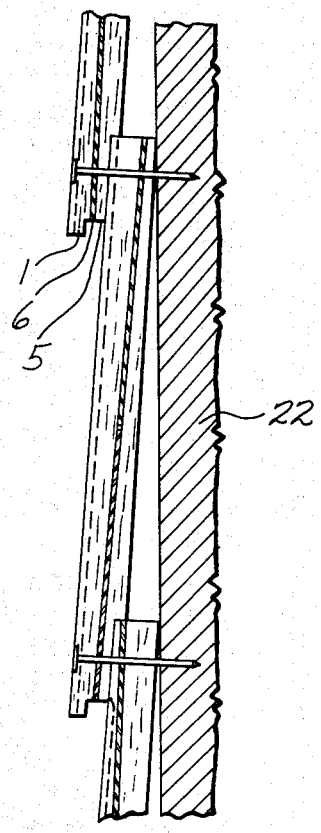
Fig. 8
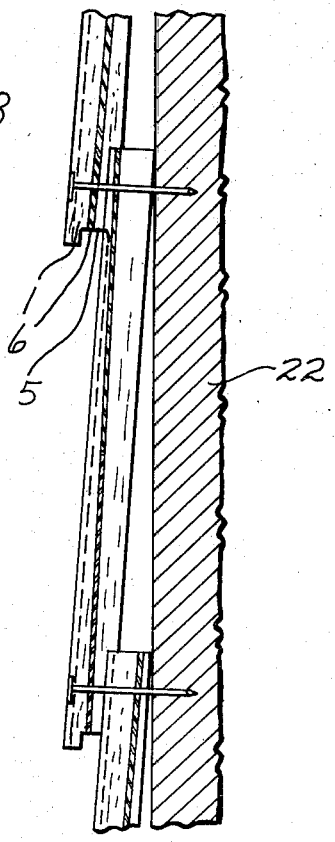

METHOD OF MAKING RABBETED SHINGLE BUTT JOINT SIDEWALL PANEL

BACKGROUND OF THE INVENTION

1. Field of the Invention

The present invention relates to shingle butt joint sidewall panels and a method of manufacturing the panels. More particularly, it relates to the manufacture of interior or exterior, colonial exposure, shingle panels with rabbeted longitudinal edges to give the appearance of individually applied shingles.

2. Prior Art

No known prior art shingle sidewall panel has an exposed or face surface which includes grooves formed by rabbeting the sides of face shingles.

SUMMARY OF THE INVENTION

For the purpose of the present invention the designation "shingle" is used to designate a small thin piece of wood usually approximately 16 inches (40.64 cm) or 18 inches (45.72 cm) in length generally parallel to the grain of the wood and of random width generally within the range of 2 inches (5.08 cm) to 12 inches (30.48 cm) transversely of the wood grain, which may be sawn with a taper from butt to tip.

It is the principal object of the present invention to manufacture shingle panels from a continuous laminated panel blank which when applied to a wall gives the appearance of individually applied shingles.

A further object is to produce such a shingle panel in which the shingles are in edge-abutting relationship to deter rain penetration.

BRIEF DESCRIPTION OF THE DRAWINGS

FIG. 1 is a schematic top perspective of apparatus for trimming the opposite edges of sidewall face shingles and rabbeting one edge, showing edge trimmers and a cam actuated router.

FIG. 3 is a schematic top perspective of apparatus for trimming and cutting the rabbeted shingle panel blank into two colonial exposure panel blanks.

FIG. 4 is an end elevation of the FIG. 3 apparatus and panel blank.

FIGS. 5A and 5B are front top perspectives of rabbeted colonial exposure shingle panels of the invention, and FIGS. 6A and 6B are rear top perspectives of such rabbeted colonial exposure shingle panels.

FIG. 7 is a vertical section of the FIG. 5B and FIG. 6B shingle panel applied to a sidewall.

FIG. 8 is a vertical section of the FIG. 5A and FIG. 6A shingle panel applied to a sidewall.

DETAILED DESCRIPTION

Figure 2:
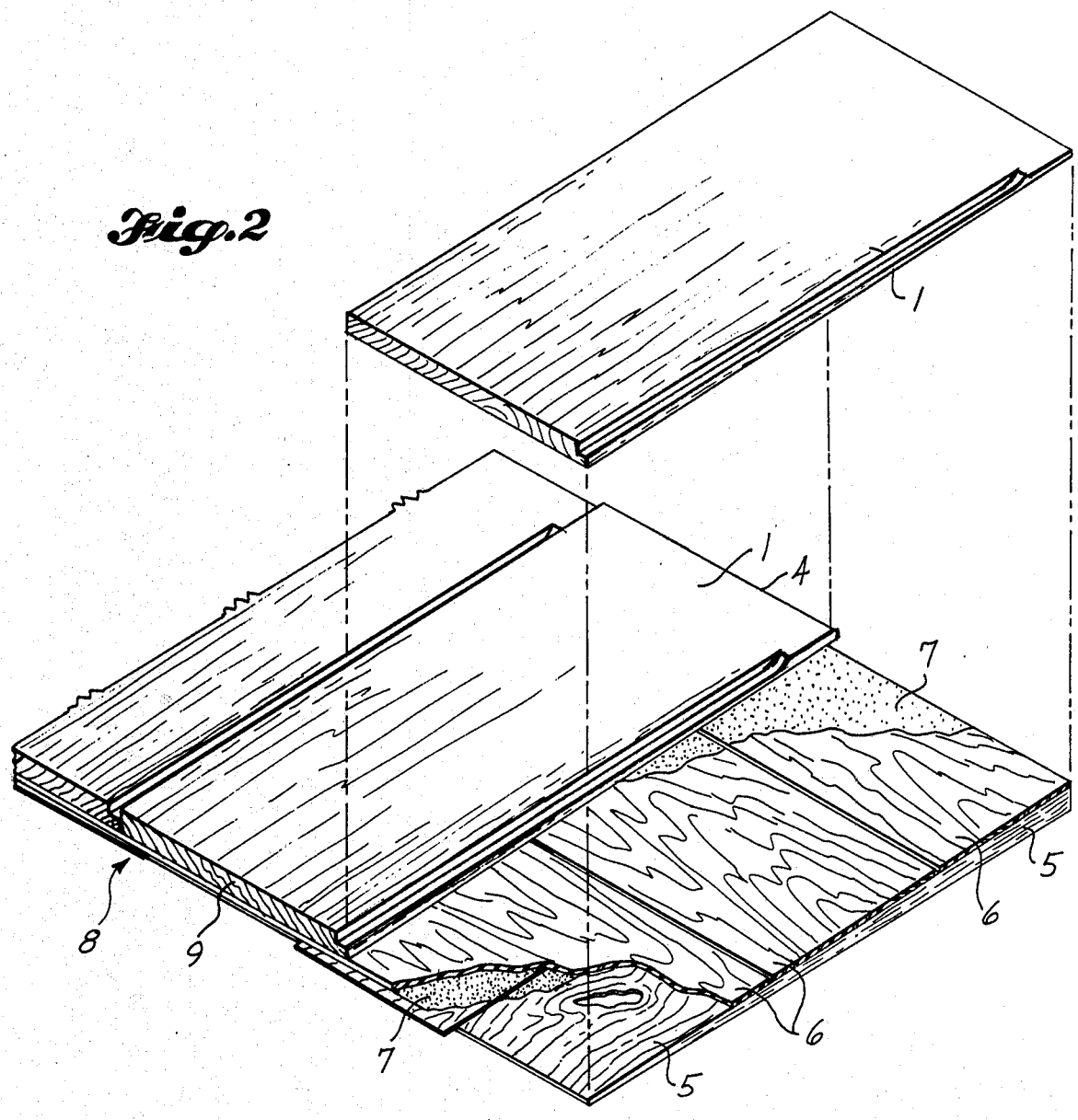
FIG. 2 is a partially exploded top perspective of a rabbeted shingle sidewall panel of the invention.

To make a sidewall panel which deters rain penetration while giving the appearance of individually applied shingles when the panel is applied to a sidewall, a rabbet is routed on one longitudinal edge of each face shingle to be incorporated in the panel, as shown in FIG. 1. The opposite longitudinal edges of each face shingle 1 are cut by edge trimmers 2 so that such edges will be parallel and smooth. Following edging, a rabbet is routed into one longitudinal edge of the face shingle by a cam-actuated router 3. The face shingle 1 is abutted against fence 10 and fed to edge trimmers 2 by the endless chain conveyor 11. As the shingle passes the edge trimmers, the trimmer heads remove a portion of each longitudinal edge creating smooth edges which are parallel. Then a rabbet of uniform depth is routed in one of the edges. The router 3 is cam actuated to enable a portion of the thinner face shingle tip 4 to pass above the router head before an end-tapered rabbet is routed into the remaining length of the shingle edge.

The rabbet is of the uniform depth of approximately 1/16 inch (0.16 cm) to ⅛ inch (0.33 cm) substantially throughout its length. Since the thickness of the tapered shingle 2 inches (5.08 cm) from the tip is approximately ⅛ inch (0.33 cm), approximately 2 inches (5.08 cm) of the longitudinal edge is not routed so that the router 3 will not cut through the entire shingle thickness. The end of the rabbet adjacent to the shingle tip may taper ¾ inch (1.90 cm) to 1 inch (2.54 cm) in length.

The rabbet is cut to the desired depth and that depth is maintained uniform over substantially its entire length by positioning the router head beneath the face shingle, pressing the face shingle against the worktable 10*a* with contact rollers 10*b*, and maintaining the router head height by means of notched cam 12. The cam engages cam follower roller 13 to swing pivoted cam crank 14 on which is mounted router 3 to engage the router head with the face shingle after the shingle tip has passed above the router head. The crank is balanced to maintain the cam follower roller in contact with the cam.

The shingle panel blanks, generally designated 8 in FIG. 2, are produced by laminating a backing layer of low-grade backing shingles or culls 5 with knots and/or flat grain, an intermediate veneer layer 6 and a face layer of rabbeted face shingles 1 bonded with a thermosetting adhesive 7. The backing shingles are laid with the tip and butt edges in substantial alignment; then a veneer sheet is laid in substantial registration with the backing shingles and having its grain and length crossing the grain and length of the backing shingles; and finally the high-grade face shingles 1 are laid with their butt edges in substantial alignment and with the shingle butts in substantial registration with such veneer edge. The shingles in the face layer are tapered in the direction opposite the direction of taper of the backing shingles 5.

The lay-up with thermosetting adhesive 7 between the layers is pressed and heated in conventional manner by a dielectrically heated press. As shown in FIG. 2, the face shingles are in edge-abutting relationship and arranged in a row transversely of their lengths and tapered in one direction. In such relationship the veneer layer creates a weather resistant barrier. Since the backing shingles are tapered in the direction opposite the direction of taper of the face layer shingles, the shingle panel blanks and shingle panels are of substantially uniform thickness. The edges of the backing shingles 5 need not be in precise edge abutment. Care should be taken to ensure that the veneer end joints do not coincide with joints of the face shingles and, preferably, the veneer end joints do not coincide with the backing shingle joints either. Such alignment promotes strength of the panel. As shown in FIGS. 3 and 4, upon being pressed and heated for curing the adhesive, a continuous sheet laminated shingle panel blank 15 is cut and trimmed. The continuous sheet blank 15 is simultaneously trimmed at the tip edge 16 by trim saw 17 trimmed at the butt edge 18 by trim saw 19 and cut generally along the center line into two continuous sheet blanks of approximately equal width by trim saw/dado 21. The multidadoed trim saw/dado 21 simultaneously cuts the sheet blank 15 and routs two ledges in each of the colonial exposure sized continuous sheet blanks.

As shown in FIG. 4, the smaller diameter dadoes of trim saw/dado 21 remove a portion of the tapered wood backing shingle 5 and the larger diameter dadoes remove a portion of the backing shingle 5, a portion of the veneer 6 and a portion of the thickness of the face shingle 1. Finally, the continuous sheet blanks are cut to length, typically 8 feet (2.4 meters), by a cutoff saw, the movement of which is synchronized with the endwise movement of the continuous sheet blanks such that the cut is perpendicular to the trimmed edges 16 and 18 of the continuous sheet blank. The resulting butt edges are shown in FIGS. 5A through 6B.

The FIG. 5A shingle panels which include the face shingle tip 4 have longitudinal edge rabbets which run out approximately 2 inches (5.08 cm) before reaching the face shingle tip, i.e. the tip end of the rabbet tapers into the face shingle surface. The FIG. 5B shingle panels, which include the face shingle butt edge 9, have longitudinal edge rabbets which extend the entire shingle length. As shown in FIGS. 7 and 8, when the shingle panels are mounted on a sidewall 22, the upper transverse ledge overlaps and abuts the upper edge of the next lower shingle panel, thereby automatically aligning the successive panels and shingle courses, and the lower transverse ledge creates an attractive shadow line. As shown in FIG. 8, the upper ledge substantially completely overlaps the unrabbeted portions of the shingles of the next lower panels. Consequently, in both types of panel the rabbeted grooves give the illusion of individually applied shingles while retaining the weather resistance of edge-abutting shingles and avoiding the unsightly appearance of extruded glue between the face shingle abutting edges.

Full, i.e. 14 inch (35.56 cm), exposure rabbeted shingle butt joint sidewall panels can be made similar to the above-described method of making rabbeted colonial exposure panels. Approximately 16 inch (40.64 cm) shingles are edge trimmed and rabbeted as discussed above with reference to the 18 inch (45.72 cm) shingles. The rabbeted shingles are then laid up into a laminated shingle panel blank about 16 inches (40.64 cm) wide.

We claim:

1. In a process for making weathertight laminated wood shingle panels including laying up an elongated backing sheet and a face layer of random width high quality wood face shingles having their lengths extending transversely of the backing sheet and generally lengthwise of their grain arranged in a row transversely of their lengths and lengthwise of the backing sheet with their longitudinal edges in edge-abutting relationship, the width of the backing sheet being substantially as great as the lengths of the shingles, and bonding the backing sheet and face layer together, the improvement comprising rabbeting, prior to assembling the face shingles in edge-abutting relationship, the face side only of a longitudinal edge of each random width face shingle generally parallel to the grain of the wood of such face shingle, and assembling the face shingles onto the backing sheet with the underside of each face shingle ungrooved.

2. The process defined in claim 1, including rabbeting the longitudinal edge of each shingle to a substantial width and depth from the butt end toward the tip end along the length of the face shingle but for a distance less than the full length of the shingle.

3. In a process for making weathertight laminated wood shingle panels including laying up an elongated backing sheet and a face layer of random width high quality wood face shingles, which face shingles are tapered in thickness generally lengthwise of their grain from butt to tip, have their lengths extending generally lengthwise of their grain and transversely of the backing sheet, and are arranged in a row transversely of their lengths and lengthwise of the backing sheet with their longitudinal edges in edge-abutting relationship, and bonding the backing sheet and face layer together, the improvement comprising rabbeting, prior to assembling the face shingles in edge-abutting relationship, the face side of the longitudinal edge of each random width face shingle to a substantially uniform depth over the portion of its length to be exposed to the weather when applied to a building structure.

4. The process defined in claim 3, including running out the rabbet adjacent to the tip of the tapered face shingle.

* * * * *

UNITED STATES PATENT AND TRADEMARK OFFICE

CERTIFICATE OF CORRECTION

PATENT NO. : 4,345,630

DATED : August 24, 1982

INVENTOR(S) : Joe L. Bockwinkel and Willis G. Pehl

It is certified that error appears in the above-identified patent and that said Letters Patent are hereby corrected as shown below:

Column 4, line 21, after "each", insert ---face---.

Signed and Sealed this

Second Day of November 1982

[SEAL]

*Attest:*

GERALD J. MOSSINGHOFF

*Attesting Officer*

*Commissioner of Patents and Trademarks*